US009584924B2

(12) United States Patent
Akino

(10) Patent No.: US 9,584,924 B2
(45) Date of Patent: Feb. 28, 2017

(54) UNIDIRECTIONAL CONDENSER MICROPHONE AND METHOD OF MANUFACTURING THE SAME

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-shi, Tokyo (JP)

( * ) Notice: Subject to any disclaimer, the term of this patent is extended or adjusted under 35 U.S.C. 154(b) by 73 days.

(21) Appl. No.: 14/572,245

(22) Filed: Dec. 16, 2014

(65) Prior Publication Data

US 2015/0201265 A1 Jul. 16, 2015

(30) Foreign Application Priority Data

Jan. 15, 2014 (JP) ..... 2014-005096

(51) Int. Cl.
*H04R 17/02* (2006.01)
*H04R 19/04* (2006.01)
*H04R 1/34* (2006.01)

(52) U.S. Cl.
CPC ..... *H04R 19/04* (2013.01); *H04R 1/342* (2013.01)

(58) Field of Classification Search
CPC ..... H04R 1/342; H04R 19/04; H04R 19/016
USPC ..... 381/369, 170–181
See application file for complete search history.

(56) References Cited

U.S. PATENT DOCUMENTS

2002/0168073 A1* 11/2002 Kajihara ..... H04R 19/016 381/113
2005/0063557 A1* 3/2005 Akino ..... H04R 1/38 381/174
2007/0165898 A1* 7/2007 Huang ..... H04R 1/086 381/369

FOREIGN PATENT DOCUMENTS

JP 2010-183249 A 8/2010

* cited by examiner

*Primary Examiner* — Ahmad F Matar
*Assistant Examiner* — Katherine Faley
(74) *Attorney, Agent, or Firm* — Manabu Kanesaka

(57) ABSTRACT

A unidirectional condenser microphone includes a diaphragm, a fixed electrode disposed opposite a back face of the diaphragm and an electrode extraction part for the fixed electrode disposed at a backside of the fixed electrode and having a through hole adapted to capture a sound wave from a rear acoustic terminal into a backside of the diaphragm. The through hole has a horn-shaped opening formed in continuation of the through hole at the rear acoustic terminal side thereof such that an inner diameter of the horn-shaped opening is increased toward the rear acoustic terminal side. The electrode extraction part has a plurality of the through holes formed therein at regular intervals along a concentric circle around an axial center of the electrode extraction part, and all the through holes along the concentric circle have the horn-shaped openings formed therein, respectively.

4 Claims, 7 Drawing Sheets

UNIDIRECTIONAL CONDENSER MICROPHONE AND METHOD OF MANUFACTURING THE SAME

RELATED APPLICATIONS

The present application is based on, and claims priority from, Japanese Application No. JP2014-005096 filed Jan. 15, 2014, the disclosure of which is hereby incorporated by reference herein in its entirety.

BACKGROUND OF THE INVENTION

Field of the Invention

The present invention relates to a unidirectional condenser microphone and its manufacturing method with which a polar pattern of the microphone can selectively be set from a cardioid pattern to a hyper cardioid pattern.

Description of the Related Art

For using a microphone, it is desired that a directivity of the microphone is appropriately selected in accordance with sound-collecting condition.

For example, for microphones belonging to a class of unidirectional microphones, in the case of collecting a sound of an instrument such as a drum, a microphone with a hyper cardioid characteristic is preferably used. And in the case of using a microphone for amplifying vocal sound or the like, a microphone with a cardioid characteristic is preferably used.

The unidirectional condenser microphone is generally configured to capture a bi-directional component into a backside of a diaphragm through an acoustic resistor provided at a rear acoustic terminal side.

Thus, in the unidirectional condenser microphone, it is technically important to set a stable acoustic impedance. Setting of the acoustic impedance affects performance of the unidirectional condenser microphone, thus, various proposals have been conventionally made.

For example, the applicant of the invention has proposed a condenser microphone with a stable acoustic resistance by adopting a device for controlling passage of a sound wave through a surface boundary between an insulating base for supporting a fixed electrode and an acoustic resistance material provided at the front side of the insulating base. This is disclosed in JP 2010-183249 A.

In addition, the applicant of the invention has proposed a configuration in which the fixed electrode is bonded to an electrode extraction part that supports the fixed electrode in JP patent application No. 2013-136102.

The unidirectional condenser microphone with a stable acoustic impedance can also be obtained by using this configuration and sandwiching the acoustic resistance material between the fixed electrode and the electrode extraction part.

In the above-mentioned unidirectional condenser microphones, the acoustic impedance is set by the acoustic resistance material in order to obtain desired directional characteristics.

Therefore, fine control of the acoustic resistance material is required for obtaining the cardioid or hyper cardioid directional characteristics as described in the beginning. This fine control of the acoustic resistance material is heavily dependent on experience and intuition of a person in charge of manufacturing.

Further, there is a problem that the acoustic impedance is not stable enough because the acoustic resistance material shows significant change over time.

For these reasons, there was a problem of variations of characteristics caused by difference among people in charge of manufacturing or deterioration of the acoustic resistance material in the conventional techniques. It was difficult to set the acoustic impedance of the unidirectional microphone stably, and there was a problem in productivity and stability of the characteristics in the conventional techniques.

SUMMARY OF THE INVENTION

The present invention has been made in view of the above-described problems of the conventional microphone. An object of the invention is to provide a unidirectional condenser microphone and its manufacturing method with which a fine control of an acoustic impedance thereof can easily be achieved and desired directional characteristics such as cardioid and hyper cardioid can be obtained with accuracy.

Further object of the invention is to provide a unidirectional condenser microphone with less change-over time in an acoustic resistance, and its manufacturing method.

In order to solve the above problem, a unidirectional condenser microphone in accordance with the present invention comprises: a diaphragm; a fixed electrode disposed opposite a back face of the diaphragm; and an electrode extraction part disposed at a backside of the fixed electrode and extracting an electrode of the fixed electrode, the electrode extraction part having a through hole adapted to capture a sound wave from a rear acoustic terminal into a backside of the diaphragm, the through hole having a horn-shaped opening formed in continuation of the thorough hole at the rear acoustic terminal side of the through hole, such that an inner diameter of the horn-shaped opening is increased toward the rear acoustic terminal side.

In this case, it is preferable that the electrode extraction part has a plurality of the through holes formed therein at regular intervals along a concentric circle around an axial center of the electrode extraction part, and all the through holes formed along the concentric circle have the horn-shaped openings formed therein, respectively.

Further, it is preferable that all the respective horn-shaped openings formed along the concentric circle have the same depths in an axial direction.

Still further, in order to solve the above problem, a method of manufacturing a unidirectional condenser microphone in accordance with the present invention comprises the steps of: preparing a diaphragm; disposing a fixed electrode opposite a back face of the diaphragm; disposing an electrode extraction part for extracting an electrode of the fixed electrode at a backside of the fixed electrode, forming a through hole in the electrode extraction part to capture a sound wave from a rear acoustic terminal into a backside of the diaphragm; and forming a horn-shaped opening in the through hole, wherein the horn-shaped opening is in continuation of the through hole and inner diameter of the horn-shaped opening is increased toward the rear acoustic terminal side.

According to the present invention, the unidirectional condenser microphone has the through hole formed in the electrode extraction part for the fixed electrode, and the though hole has the horn-shaped opening formed at the rear acoustic terminal side of the through hole. The horn-shaped opening is formed in continuation of the through hole formed in the electrode extraction part, and inner diameter thereof is increased toward the rear acoustic terminal side.

In the case where an open area of the horn-shaped opening is small, the microphone works as an acoustic transducer connected with a high acoustic impedance, and in the case where the open area is large, the microphone works as an acoustic transducer connected with a low acoustic impedance.

Thus, the acoustic impedance can be adjusted by additionally machining the through hole formed in the electrode extraction part for the fixed electrode. This additional machining is to open the through hole in a horn shape, from the backside of the electrode extraction part. Depending on the degree of the additional machining (amount of undercutting the horn-shaped opening), the acoustic resistance can gradually be lowered.

According to the above-mentioned aspect of the invention, it becomes possible to set the directional characteristics of the unidirectional condenser microphone selectively in a range from a cardioid to a hyper cardioid.

DESCRIPTION OF THE PREFERRED EMBODIMENTS

Hereinafter, embodiments of a unidirectional condenser microphone in accordance with the present invention will be described with reference to FIGS. 3A and 3B and following drawings. Firstly, an example of main components of the unidirectional condenser microphone will be described with reference to FIGS. 1, 2A, and 2B.

Figure 1:
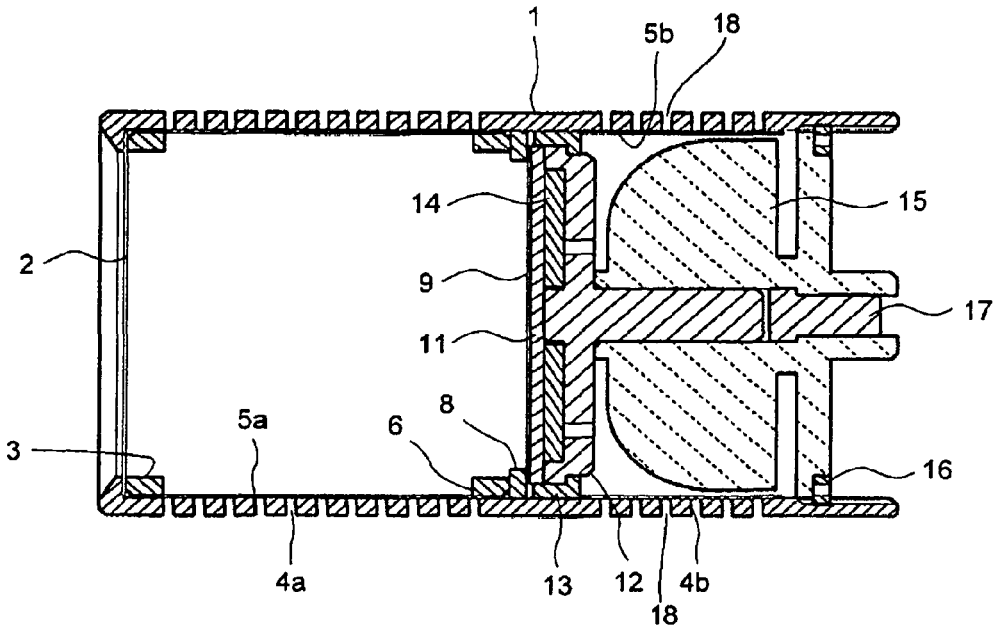
Fig. 1 Prior Art
FIG. 1 is a cross sectional view illustrating an example of a unidirectional condenser microphone.

FIG. 1 shows an example of a rod-shaped unidirectional condenser microphone, known as an end-address microphone having a directivity in an axial direction of a cylindrical case.

The reference number 1 shows a microphone case. The microphone case 1 is formed in a cylindrical shape with a forward side in the axial direction thereof being open. A guard net 2 is attached to the open portion by a support ring 3 for dust prevention.

A plurality of slit-like openings 4*a* are formed around the microphone case 1 in the forward side of the axial direction of the microphone case 1. The slit-like openings 4*a* are formed to be orthogonal to the axis line of the microphone case 1 and have a space between each other. This slit-like opening 4*a* works as a through opening that captures a sound wave therethrough.

A metal net 5*a* formed in a cylindrical shape is disposed on an inner surface of the slit-like opening 4*a* formed in the microphone case 1. The metal net 5*a* is supported by the support ring 3 at a front portion thereof, and supported by a support ring 6 at a rear portion thereof. The support ring 6 has the same shape as the support ring 3 at the front portion.

A diaphragm ring 8 is being positioned within the microphone case 1. The support ring 6 is used for the positioning. The diaphragm ring 8 holds a diaphragm 9 at a predetermined tension. A fixed electrode 11 is disposed opposite a back face of this diaphragm 9.

The fixed electrode 11 is supported by a supporting member 13 with an electrode extraction part 12 for the fixed electrode. The electrode extraction part 12 is disposed at a backside of the fixed electrode 11. The supporting member 13 is L-shaped in cross section and mounted within the microphone case 1.

It is to be noted that the fixed electrode 11 has an electret film (not shown) formed on a side opposite the diaphragm 9.

And the electrode extraction part 12 is made of a metal material such as brass.

Figure 2A:
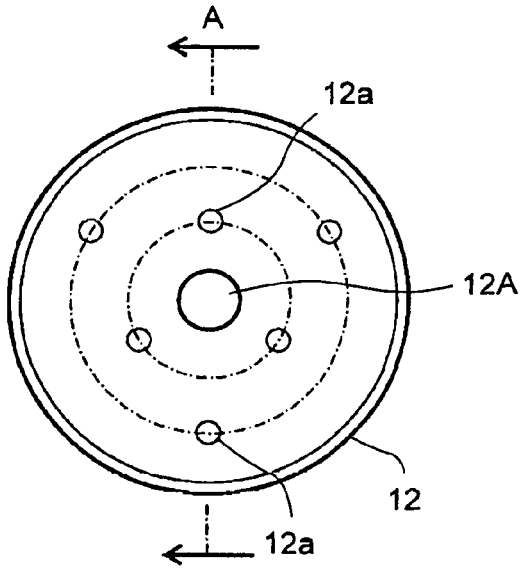
Fig. 2A Prior Art
FIG. 2A is a rear view of an electrode extraction part of the condenser microphone illustrated in FIG. 1.
Figure 2B:
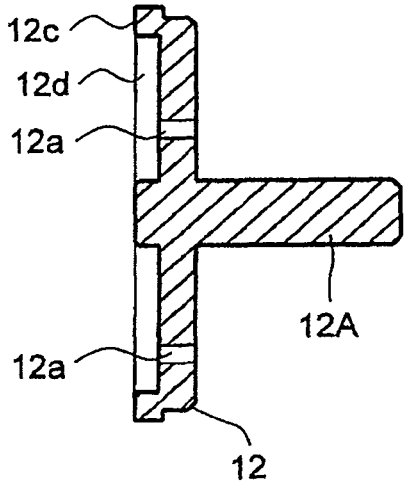
Fig. 2B Prior Art
FIG. 2B is a cross-sectional view taken along the line A-A of the rear view of the electrode extraction part of the condenser microphone illustrated in FIG. 1.

The electrode extraction part 12 is shown solely in FIGS. 2A and 2B. An electrode rod 12A is integrally formed with the disc-shaped electrode extraction part 12 (main body) along an axial center of the main body as shown in FIGS. 2A and 2B. Further, the disk-shaped main body has a plurality of through holes 12*a* formed therein for capturing a sound wave from a rear acoustic terminal 18 into the backside of the diaphragm 9.

For convenience of explanation, two concentric circles around an axial center of the electrode extraction part 12 are indicated by dashed lines in FIG. 2A, and three through holes 12*a* are respectively formed along respective concentric circles at regular intervals.

Further, the electrode extraction part 12 has a bent portion 12*c* formed by bending a peripheral edge thereof forwardly. A space 12*d* is formed between the backside of the fixed electrode 11 and the electrode extraction part 12 by the bent portion 12*c*. And as shown in FIG. 1, an acoustic resistance member 14 is housed in the space 12*d*.

Within the microphone case 1, an insulating base 15 is mounted by a lock ring 16 at the back face of the electrode extraction part 12.

The insulating base 15 is formed into approximately hemispherical shape having a rounded front end part so as to form a space between the back face of the electrode extraction part 12 and the insulating base 15.

The microphone case 1 has a slit-like opening 4*b* formed to communicate with the space between the back face of the electrode extraction part 12 and the insulating base 15.

In a same manner as the slit-like opening 4*a* formed in the forward side of the microphone case 1, the slit-like openings 4*b* are formed in the microphone case 1 so as to be orthogonal to the axis line of the microphone case 1 and have a space between each other. The slit-like openings 4*b* are formed in the rear of the microphone case 1, and a metal net 5*b* is disposed on an inner surface of the slit-like opening 4*b*.

It is to be noted that an extraction rod 17 is attached to the insulating base 15. An audio signal output from the microphone unit is derived via the extraction rod 17.

As described the above, in the condenser microphone shown in FIG. 1, a rear acoustic terminal 18 is located outside the slit-like opening 4*b* formed in the rear of the microphone case 1.

Figure 3A:
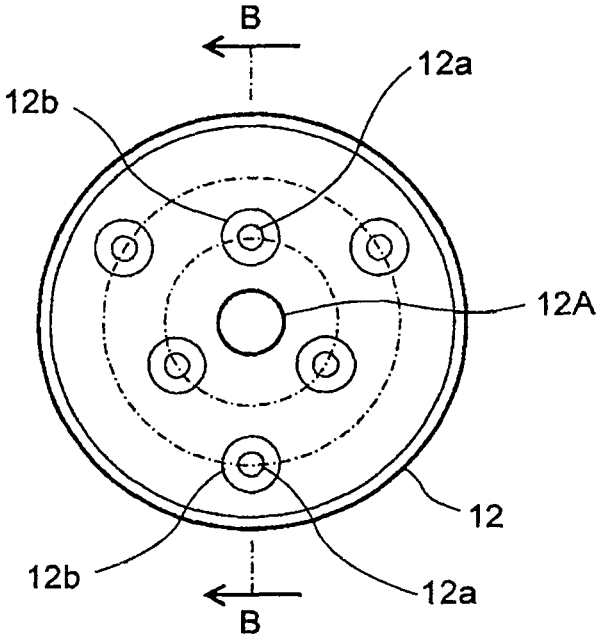
FIG. 3A is a rear view of a first form of the electrode extraction part of the condenser microphone according to the present invention.
Figure 3B:
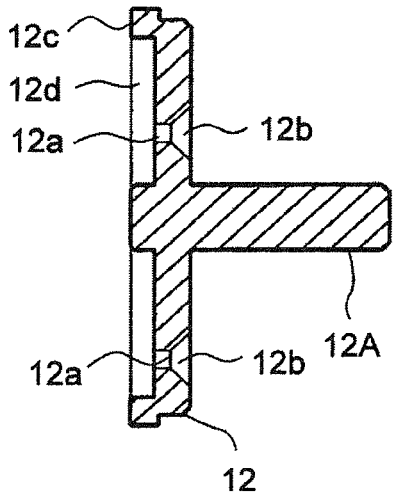
FIG. 3B is a cross-sectional view taken along the line B-B of the rear view of the first form of the electrode extraction part of the condenser microphone according to the present invention.

FIGS. 3A and 3B show a first form of the electrode extraction part of the condenser microphone according to the present invention. That is, the condenser microphone according to the present invention is made by attaching the electrode extraction part 12 shown in FIGS. 3A and 3B to the condenser microphone shown in FIG. 1.

For the electrode extraction part 12 shown in FIG. 3A and the following drawings, corresponding elements to the elements of the electrode extraction part shown in FIGS. 2A and 2B are designated by the same reference numerals as the reference numerals of FIGS. 2A and 2B, and a detailed description thereof is omitted.

The electrode extraction part 12 shown in FIGS. 3A and 3B has a through hole 12*a* having a horn-shaped opening 12*b* formed therein. The opening 12*b* is formed in continuation of the through hole 12*a* for capturing a sound wave from the rear acoustic terminal 18 into the backside of the diaphragm 9, and an inner diameter of the opening 12*b* is increased toward the rear acoustic terminal side.

That is, length dimension in the axial direction of the through hole 12*a* is adjusted by forming the horn-shaped opening 12*b* in continuation of the through hole 12*a*, and a desired acoustic impedance can thereby be set.

Figure 4A:
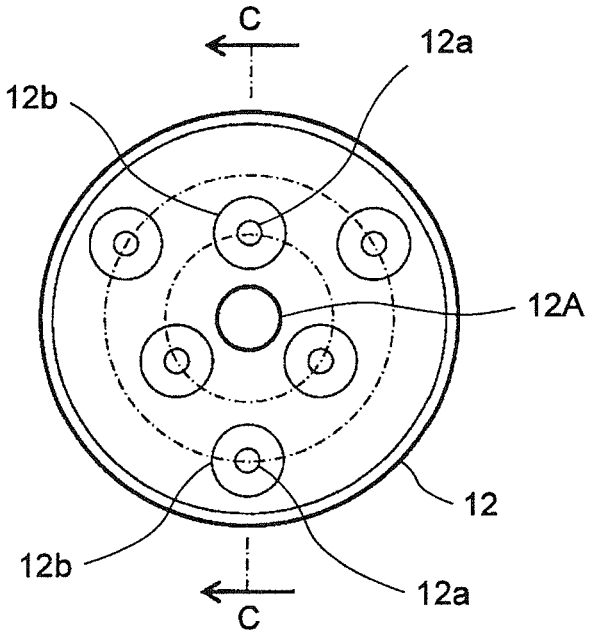
FIG. 4A is a rear view of a second form of the electrode extraction part.
Figure 4B:
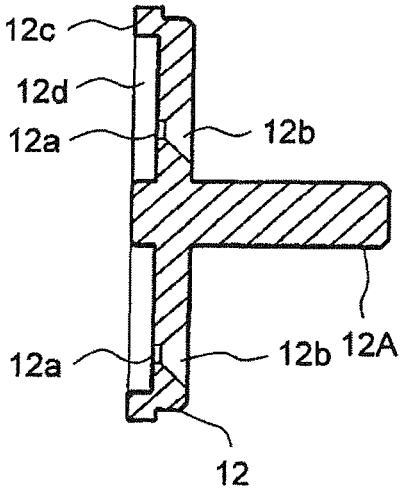
FIG. 4B is a cross-sectional view taken along the line C-C of the second form of the electrode extraction part.

FIGS. 4A and 4B shows an example of the electrode extraction part 12 in which the depth in the axial direction of the horn-shaped opening 12*b* is further increased. According to this example, the length dimension in the axial direction of the through hole 12 is shortened, and the acoustic impedance is set lower compared with the example shown in FIGS. 3A and 3B.

Figure 5:
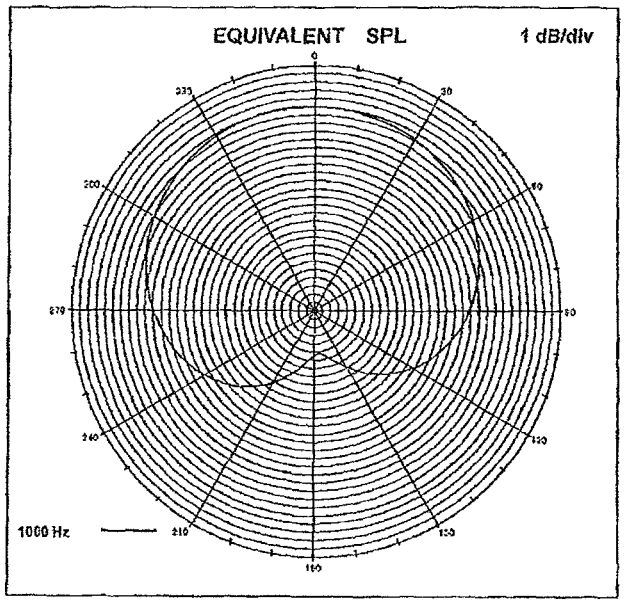
FIG. 5 is a polar pattern diagram showing a directional characteristic in the case of using the electrode extraction part shown in FIGS. 2A and 2B.
Figure 6:
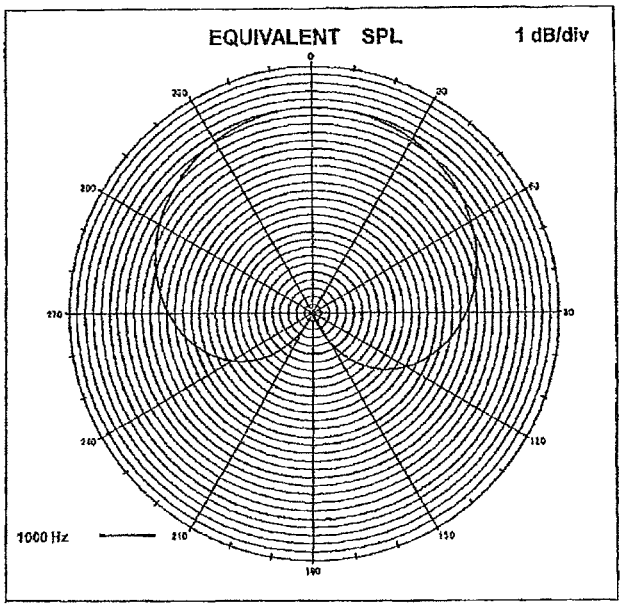
FIG. 6 is a polar pattern diagram showing a directional characteristic in the case of using the electrode extraction part shown in FIGS. 3A and 3B.
Figure 7:
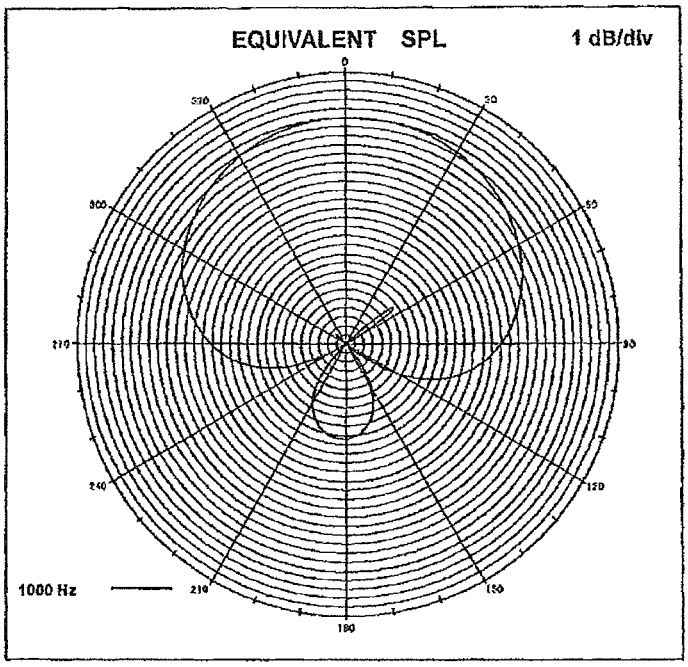
FIG. 7 is a polar pattern diagram showing a directional characteristic in the case of using the electrode extraction part shown in FIGS. 4A and 4B.

FIGS. 5 to 7 show polar pattern diagrams showing directional characteristics obtained by attaching respective electrode extraction parts 12 shown in FIGS. 2A to 4B to the condenser microphone shown in FIG. 1.

In the case of using the electrode extraction part 12 shown in FIGS. 2A and 2B, as the polar pattern diagram of FIG. 5 shows, the ideal cardioid characteristics is not obtained. This is because less bi-directional components are captured from the rear acoustic terminal side into the backside of the diaphragm, and caused by a high acoustic impedance in the rear acoustic terminal side.

The ideal cardioid characteristics as shown in FIG. 6 can be obtained by using the electrode extraction part 12 shown in FIGS. 3A and 3B. Further, as shown in FIG. 7, it is understood that supercardioid characteristics can be obtained by the condenser microphone using the electrode extraction part shown in FIGS. 4A and 4B.

That is, it is obviously understood that the acoustic impedance in the rear acoustic terminal side can be adjusted depending on the depth in the axial direction of the horn-shaped opening 12*b* formed in the through hole 12*a* of the electrode extraction part 12.

A plurality of the horn-shaped openings 12*b* are preferably formed in all the respective through holes 12*a* arranged at regular intervals along the concentric circle. In addition, all the horn-shaped openings formed along the concentric circle preferably have the same depths in the axial direction.

This is a necessary condition for balancing without generating a bias of the acoustic impedance working in the backside of the diaphragm.

FIGS. 8A to 8B and 9A to 9B show other possible examples of the electrode extraction part 12 that could be adopted to the condenser microphone in accordance with the present invention.

Figure 8A:
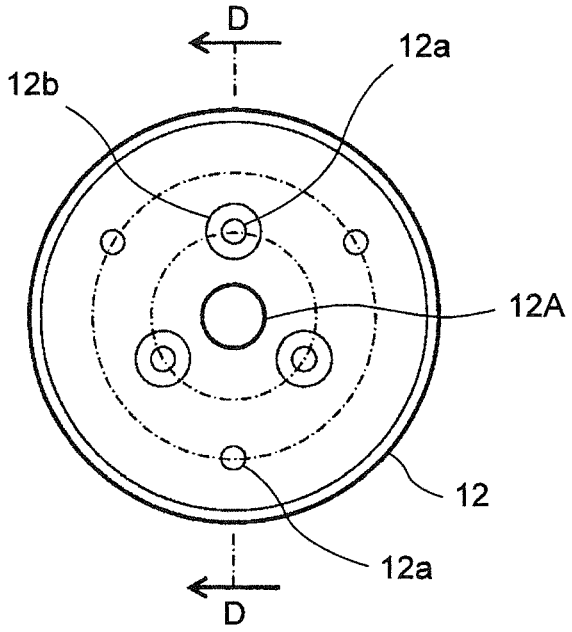
FIG. 8A is a rear view of a third form of the electrode extraction part of the condenser microphone according to the present invention.
Figure 8B:
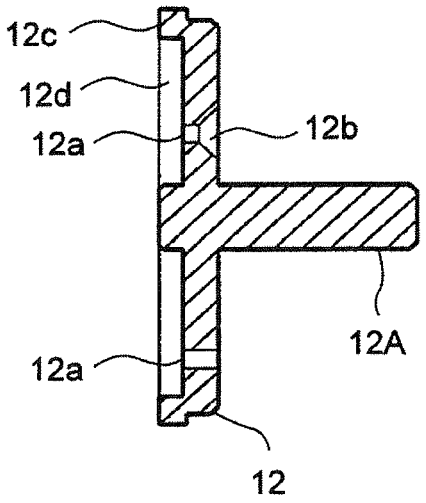
FIG. 8B is a cross-sectional view taken along the line D-D of the third form of the electrode extraction part of the condenser microphone according to the present invention.

For the example shown in FIGS. 8A and 8B, the horn-shaped openings 12*b* are formed in all the through holes 12*a* arranged along the inner concentric circle at regular intervals. And all the respective horn-shaped openings 12*b* formed along the inner concentric circle have the same depths in the axial direction.

Figure 9A:
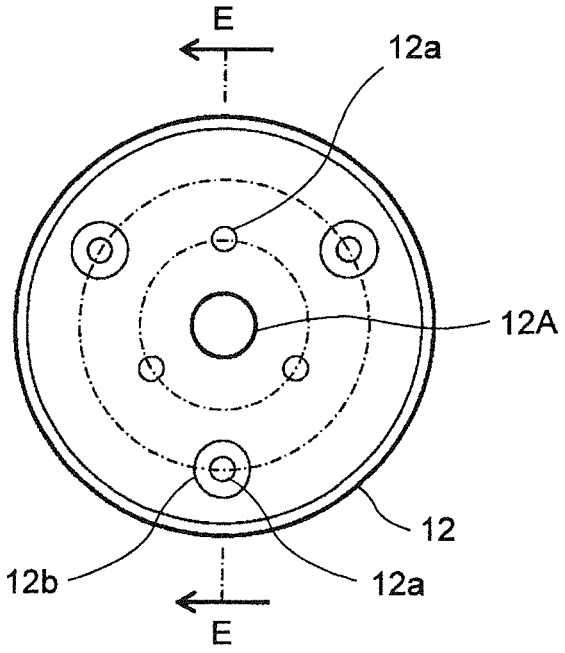
FIG. 9A is a rear view of a fourth form of the electrode extraction part.
Figure 9B:
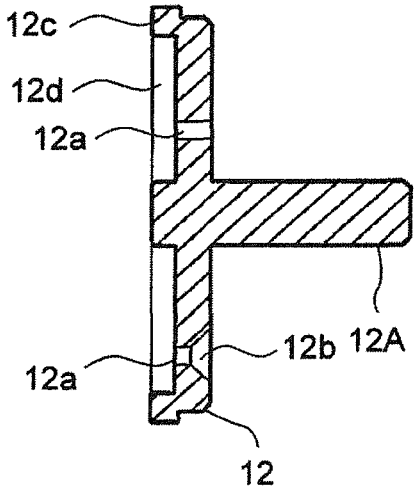
FIG. 9B is a cross-sectional view taken along the line E-E of the fourth form of the electrode extraction part.

For the example shown in FIGS. 9A and 9B, the horn-shaped openings 12*b* are formed in all the through holes 12*a* arranged along the outer concentric circle at regular intervals. And all the respective horn-shaped openings 12*b* formed along the outer concentric circle have the same depths in the axial direction.

As is obvious from the above description, according to the unidirectional condenser microphone and its manufacturing method of the present invention, a desired acoustic impedance can be obtained by forming the horn-shaped opening in continuation of the through hole formed in the electrode extraction part for the fixed electrode such that the inner diameter of the horn-shaped opening is increased toward the rear acoustic terminal side. The directional characteristics of the unidirectional condenser microphone can thereby be set selectively in a range from the cardioid to the hyper cardioid.

Further, a problem of variations of characteristics caused by difference among people in charge of manufacturing and their skill levels can be solved by setting parameters such as the depth in the axial direction and size of the horn-shaped opening 12*b*. Further, change in characteristics caused by amount or deterioration of the acoustic resistance material can also be prevented. A unidirectional condenser microphone with stable characteristics can thereby be provided.

What is claimed is:

1. A unidirectional condenser microphone comprising:

a diaphragm;

a fixed electrode disposed opposite a back face of the diaphragm; and an electrode connection part disposed at a backside of the fixed electrode and having a through hole adapted to capture a sound wave from a rear acoustic terminal into a backside of the diaphragm, the through hole having a horn-shaped opening formed in continuation of the through hole at a rear acoustic terminal side of the through hole, such that an inner diameter of the horn-shaped opening is increased toward the rear acoustic terminal side, wherein the electrode connection part is formed from a metal material, the through hole of the electrode connection part further has a cylindrical opening on a side opposite to the rear acoustic terminal side and extending to the horn-shaped opening, the electrode connection part has a plurality of the through holes arranged at a first distance from an axial center of the electrode connection part and at a second distance, greater than the first distance, from the axial center of the electrode connection part, and the plurality of the through holes is spaced equally from each other in a circumferential direction of the electrode connection part.

2. The unidirectional condenser microphone as claimed in claim 1, wherein all the respective horn-shaped openings have same depths in an axial direction.

3. A unidirectional condenser microphone comprising:

a diaphragm;

a fixed electrode disposed opposite a back face of the diaphragm; and an electrode connection part disposed at a backside of the fixed electrode and having a through hole adapted to capture a sound wave from a rear acoustic terminal into a backside of the diaphragm, the through hole having a horn-shaped opening formed in continuation of the through hole at a rear acoustic terminal side of the through hole, such that an inner diameter of the horn-shaped opening is increased toward the rear acoustic terminal side, wherein the electrode connection part is formed from a metal material, the through hole of the electrode connection part further has a cylindrical opening on a side opposite to the rear acoustic terminal side and extending to the horn-shaped opening, the electrode connection part has a plurality of the through holes arranged at a first distance from an axial center of the electrode connection part and spaced equally from each other in a circumferential direction of the electrode connection part, each of the plurality of the through holes having the horn-shaped opening, and the electrode connection part further comprises a plurality of further through holes arranged at a second distance, greater than the first distance, from the axial center of the electrode connection part and spaced equally from each other in the circumferential direction of the electrode connection part, each of the plurality of further through holes having a cylindrical shape continuously extending through the electrode connection part.

4. A unidirectional condenser microphone comprising:

a diaphragm;

a fixed electrode disposed opposite a back face of the diaphragm; and an electrode connection part disposed at a backside of the fixed electrode and having a through hole adapted to capture a sound wave from a rear acoustic terminal into a backside of the diaphragm, the through hole having a horn-shaped opening formed in continuation of the through hole at a rear acoustic terminal side of the through hole, such that an inner diameter of the horn-shaped opening is increased toward the rear acoustic terminal side, wherein the electrode connection part is formed from a metal material, the through hole of the electrode connection part further has a cylindrical opening on a side opposite to the rear acoustic terminal side and extending to the horn-shaped opening, the electrode connection part has a plurality of the through holes arranged at a first distance from an axial center of the electrode connection part and spaced equally from each other in a circumferential direction of the electrode connection part, each of the plurality of the through holes having the horn-shaped opening, and the electrode connection part further comprises a plurality of further through holes arranged at a second distance, less than the first distance, from the axial center of the electrode connection part and spaced equally from each other in the circumferential direction of the electrode connection part, each of the plurality of further through holes having a cylindrical shape continuously extending through the electrode connection.

* * * * *